US007532095B2

(12) United States Patent
Schmidt et al.

(10) Patent No.: US 7,532,095 B2
(45) Date of Patent: May 12, 2009

(54) APPARATUS FOR REMOTELY ACTUATING A MANUAL ACTUATOR OF A CIRCUIT BREAKER

(75) Inventors: Wolfgang Schmidt, Berg (DE); Johann Kellermann, Altdorf (DE)

(73) Assignee: Ellenberger & Poensgen mbH, Altdorf (DE)

( * ) Notice: Subject to any disclaimer, the term of this patent is extended or adjusted under 35 U.S.C. 154(b) by 162 days.

(21) Appl. No.: 11/804,681

(22) Filed: May 18, 2007

(65) Prior Publication Data

US 2007/0222543 A1 Sep. 27, 2007

Related U.S. Application Data

(63) Continuation of application No. PCT/EP2006/003187, filed on Apr. 7, 2006.

(30) Foreign Application Priority Data

May 27, 2005 (DE) ..... 10 2005 024 270

(51) Int. Cl.
*H01H 75/00* (2006.01)
*H01H 17/00* (2006.01)
*H01H 3/20* (2006.01)

(52) U.S. Cl. ..... 335/6; 335/11; 335/68; 200/331

(58) Field of Classification Search ..... 335/6, 335/11, 68; 200/331
See application file for complete search history.

(56) References Cited

U.S. PATENT DOCUMENTS 3,332,043 A * 7/1967 Camp ..... 335/71
5,838,219 A * 11/1998 Du et al. ..... 335/14

FOREIGN PATENT DOCUMENTS

DE 37 11 138 A1 10/1988
EP 0 872 867 A2 10/1998
EP 0 883 150 A2 12/1998

* cited by examiner

*Primary Examiner*—Ramon M Barrera
(74) *Attorney, Agent, or Firm*—Laurence A. Greenberg; Werner H. Stemer; Ralph E. Locher

(57) ABSTRACT

An apparatus for remotely actuating a circuit breaker with two stable positions corresponding to a switch-on position and a switch-off position, has a drive mechanism with an electric motor. The apparatus further has first and second switches for switching the motor on and off, a transmission, a coupling mechanism for mechanically coupling the drive mechanism to the circuit breaker and a lever. The transmission can be positioned in two basic positions, and the lever is capable of being moved from a first end position into a second end position with the aid of the drive mechanism. The drive mechanism is configured such that, in the event of the lever being moved over manually from one end position into the other end position, one of the switches is actuated, with the result that the transmission is moved over from one basic position into the other basic position.

14 Claims, 12 Drawing Sheets

APPARATUS FOR REMOTELY ACTUATING A MANUAL ACTUATOR OF A CIRCUIT BREAKER

CROSS-REFERENCE TO RELATED APPLICATIONS

This is a continuing application, under 35 U.S.C. §120, of copending international application No. PCT/EP2006/003187, filed Apr. 7, 2006, which designated the United States; this application also claims the priority, under 35 U.S.C. §119, of German patent application No. DE 10 2005 024 270.7, filed May 27, 2005; the prior applications are herewith incorporated by reference in their entirety.

BACKGROUND OF THE INVENTION

1. Field of the Invention

The invention relates to an apparatus for remotely actuating a circuit breaker with two stable positions corresponding to a switch-on position and a switch-off position. The apparatus has a drive mechanism with an electric motor, a first and a second switch for switching the electric motor on and off, a transmission, a coupling mechanism, which is provided for mechanically coupling the drive mechanism to the breaker and a lever. The transmission is capable of being positioned in two basic positions, and the lever is capable of being positioned in two end positions. The lever is capable of being moved from its one end position into the other end position with the aid of the drive mechanism in a remotely actuable fashion.

Circuit breakers are used for disconnecting circuits in the event of excess current. A circuit breaker isolates the circuit as soon as its rated current level has been exceeded by a specific factor. This protects the load or the line from damage or destruction owing to the thermal influence of the current. In general, there are thermal, thermal-magnetic, magnetic and hydraulic-magnetic circuit breakers and line circuit breakers.

Switches are known, including circuit breakers, which are mechanically coupled to an apparatus for remote actuation. Such apparatuses make it possible to actuate a switch remotely. In this case, a switching mechanism of the circuit breaker is acted upon in particular via a manual actuator or switching button which can be actuated manually. An apparatus for remotely actuating a switch makes it possible to switch a circuit breaker both off and on remotely. In this case, auxiliary electrical energy is required for the electric motor of the apparatus.

Such an apparatus is specified, for example, in U.S. Pat. No. 5,838,219. Therein, a circuit breaker with a remote drive fitted thereto is described, the movements of the manual actuator, which is, in the form of a switching rocker, of the circuit breaker are controlled via a switching rocker of the remote drive. The switching rocker of the remote drive is capable of being actuated with the aid of a drive mechanism. For this purpose, an actuating member moves between two positions. In the case of manual actuation of the switching rocker of the circuit breaker or of the remote drive, the actuating member needs to be changed over in order to make future remote actuation possible.

SUMMARY OF THE INVENTION

It is accordingly an object of the invention to provide an apparatus for remotely actuating a manual actuator of a circuit breaker, which overcomes the herein-mentioned disadvantages of the heretofore-known devices of this general type, which makes safe and reliable remote actuation of a manual actuator of a circuit breaker possible even in the event of manual actuation of the manual actuator, in the meantime.

With the foregoing and other objects in view there is provided, in accordance with the invention, an apparatus for remotely actuating a circuit breaker having two stable positions including a switch-on position and a switch-off position. The apparatus contains a drive mechanism. The drive mechanism has an electric motor, switches, including a first switch and a second switch, for switching the electric motor on and off, and a transmission capable of being positioned in two basic positions, including a first basic position and a second basic position. A coupling mechanism having a lever is provided for mechanically coupling the drive mechanism to the circuit breaker. The lever has two end positions and are capable of being moved from a first end position into a second end position with an aid of the drive mechanism. The drive mechanism is configured such that, in an event of the lever being moved over manually from the first end position into the second end position, one of the first and second switches is actuated, resulting in the transmission moving over from the first basic position into the second basic position.

Accordingly, the apparatus has a drive mechanism, which is configured such that, in the event of the lever being moved over manually from one end position into the other end position, one of the switches is actuated such that the transmission is moved over from one basic position into the other basic position.

A decisive advantage of the configuration can be considered to be that synchronization of the manual and remote-controlled changeover of the manual actuator is achieved, i.e., in the event of manual actuation of the manual actuator, the drive mechanism is automatically followed. Simple and reliable operation of the apparatus is made possible by two basic positions of the transmission being defined, depending on the actuation of one of the two switches. With the aid of the drive mechanism having such a configuration, the transmission is automatically moved over from one of the two basic positions into the other, which two basic positions are correlated with the two end positions of the lever or with the switch-on and switch-off position of the manual actuator, irrespective of whether the manual actuator is switched on or off manually or by remote control. Since one of the two switches is used for the process of the drive mechanism automatically being followed, no additional switch or tripping mechanism is required, which makes a compact and simple configuration possible.

Automatic synchronization takes place even after electric tripping of the circuit breaker. In the event of there being no operating voltage available to the drive, the circuit breaker remains ready for operation in an unrestricted fashion. Synchronization of the drive with respect to the respective switching state of the circuit breaker automatically takes place once the operating voltage has been applied.

Preferably, the first switch is a normally open contact, and the second switch, which is connected in series therewith, is a normally closed contact. The normally open contact is defined as being a switch which, in its normal, unactuated position, is open (NO contact). The normally closed contact is defined, in contrast, as being a switch which is closed in its normal position (NC contact). The electric motor is therefore at a standstill if both switches are actuated at the same time or both are not actuated at the same time. In the first basic position of the transmission, preferably both switches are not actuated, i.e. the circuit for supplying the electric motor is opened by the normally open contact. Moving the manual actuator over closes the first switch, and the transmission runs until the second switch is actuated and thereby opened. This corresponds to the second basic position of the transmission. Irrespective of whether the manual actuator is moved over by remote actuation or manually, in both cases the transmission is moved from one basic position into the other basic position by use of the two switches being closed or opened in combined fashion. Owing to this configuration, which is simple in terms of circuitry, and interaction of the components, reliable operation of the apparatus is ensured.

Preferably, the lever has an axis of rotation, about which it can be rotated when switching over from one end position to the other end position along an arc of a circle. The rotary movement of the lever is correlated with the rotary movement of the manual actuator; in particular it corresponds to the rotary movement of the manual actuator. Owing to the rotary movement of the manual actuator being reproduced by the rotary movement of the lever, a simple mechanical connection between the circuit breaker and the apparatus is made possible. In this case, only a correlation of the end positions of the lever with the basic positions of the transmission is required, which is achieved by simple mechanical measures.

Further preferably, the drive mechanism has a cam disk, the two basic positions of the transmission being defined via the cam disk and, for example, being offset by half a revolution of the cam disk. Therefore, starting from one of the basic positions of the transmission and one of the end positions of the lever, which are related to one another, after half a revolution of the cam disk the other basic position of the transmission is reached at the same time as the other end position of the lever, and the electrical supply to the electric motor is switched on or off.

In accordance with one preferred embodiment of the apparatus, the cam disk is capable of rotation only in one direction. The drive mechanism therefore only needs to be configured for one direction of rotation and polarity reversal of the electric motor for the purpose of changing the direction of rotation is not required.

Advantageously, the cam disk actuates the first switch via a direct contact. The switch is in particular positioned such that it is in touching contact with the circumferential side of the cam disk, and the switch is actuated by this touching contact. In order to switch the switch off, a cutout is expediently introduced at at least one point along the circumferential side of the cam disk.

It is furthermore advantageous if the lever is connected to the cam disk via a coupling element, which is disposed on the cam disk such that it can rotate at an articulation point, the articulation point being spaced apart from an axis of rotation of the cam disk. The articulation point is therefore displaced along a circular path when the cam disk rotates and, with it, also one side of the coupling element. The rotatable connection between the coupling element and the cam disk ensures a high degree of flexibility of the movements of the coupling element along the entire circular path.

Preferably, the coupling element has a slot in the form of a slotted link, in which slot a pin of the lever runs. The slot likewise provides a high degree of flexibility of the connection between the coupling element and the lever. The pin of the lever can therefore move freely along the slot during the circular movement of the coupling element.

Furthermore, the coupling element preferably has an attachment, which is provided for the mechanical contact with the second switch. The attachment is configured such that the contact with the switch is only produced at one point or in one region of the path described by the coupling element during its movement. Owing to the series circuit containing the two switches, which are in the form of a normally closed contact and a normally open contact, the energy supply to the electric motor is interrupted by this measure in a predetermined transmission position. The contact between the attachment and the second switch is therefore provided for the purpose of interrupting the circuit as soon as the cam disk is located in one of the basic positions.

Preferably, the first switch is capable of being actuated by the coupling element or by the cam disk via direct mechanical contact. In the event of remote-controlled actuation of the manual actuator of the circuit breaker, the electric motor is started up with a short current pulse, the cam disk rotates and actuates, with its circumferential side, the first switch, with the result that the circuit is closed. In the event of a manual change in the end position of the lever, in contrast the first switch is actuated via a mechanical contact with the coupling element. The change in position of the lever therefore also automatically moves the coupling element, with the result that the first switch is actuated, the electric motor is started, and the transmission is brought automatically into its other basic position.

In one advantageous embodiment of the apparatus, the lever has a driver, in particular in the form of an aperture, which is provided for accommodating a coupling member in interlocking fashion, which connects the apparatus to the manual actuator. Owing to the coupling element, the correlation of the lever with the manual actuator takes place by the rotary movement of the lever being transmitted to the manual actuator. If the circuit breaker and the apparatus for remotely actuating the circuit breaker are disposed next to one another, the coupling element may be in the form of a pin. The pin conducts the torque of the manual actuator to the lever, and vice versa.

In one preferred configuration, the electric motor is capable of being switched on and off by a pushbutton. The pushbutton triggers the current pulse to the electric motor, the electric motor actuates the transmission and brings it into its other basic position, in which the circuit is interrupted. At the same time, the lever is brought into its other end position, and its rotary movement is in the process transmitted to the manual actuator.

Advantageously, the apparatus has separate ON and OFF pushbuttons or a changeover switch, on whose actuation the transmission is capable of being moved over from its first basic position into the second basic position, and vice versa.

In another advantageous embodiment of the apparatus, only one OFF pushbutton is provided, on whose actuation the transmission is moved into a basic position, which is correlated with the switch-off position of the manual actuator.

Other features which are considered as characteristic for the invention are set forth in the appended claims.

Although the invention is illustrated and described herein as embodied in an apparatus for remotely actuating a manual actuator of a circuit breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
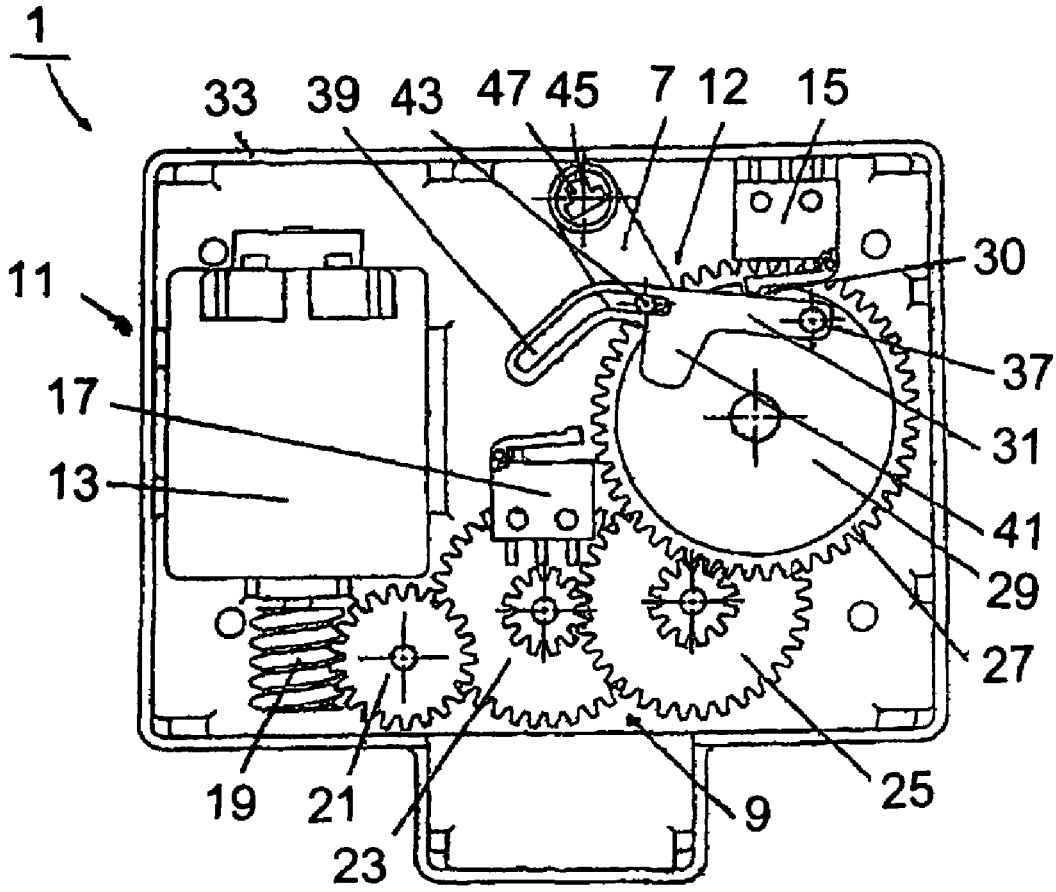
FIG. 1 is a diagrammatic, plan view of an apparatus for remotely actuating a manual actuator of a circuit breaker in an OFF end position of a lever according to the invention.

Functionally identical parts are provided with the same reference symbols in the figures. Referring now to the figures of the drawing in detail and first, particularly, to FIGS. 1-7 thereof, there is shown an apparatus 1, for remotely actuating a manual actuator 3 of a circuit breaker 5 (see FIGS. 6 and 7) that has a drive mechanism 11 and a coupling mechanism 12 (FIG. 1). In the exemplary embodiment, the drive mechanism 11 has an electric motor 13, a first switch 15 and a second switch 17 as well as a transmission 9. The transmission 9 contains a worm 19, three stepped gearwheels 21, 23 and 25, an output gearwheel 27 and a cam disk 29 with a cutout 30. The coupling mechanism 12 has a lever 7 and a coupling element 31. The components of the apparatus 1 are mounted in a housing 33 and a cover 35 (see FIG. 5). The output gearwheel 27 and the cam disk 29 are fixedly connected to one another and may also be formed as one part. The coupling element 31 is connected, in a manner such that it can rotate, to the cam disk 29 at one of its ends at an articulation point 37, which is in the form of an axis. On the left-hand side at the other end of the coupling element 31 there is a slot 39 in the form of a slotted link. In the region of the slot 39, the coupling element 31 is bent back in the form of an L, but alternatively other shapes of the slot are also possible. The coupling element 31 has an attachment 41 between the articulation point 37 and the slot 39. A pin 43 of the lever 7 runs in the slot 39. The lever 7 is mounted such that it can rotate in the housing 33 on an axis 45 at right angles to the surface of the drawing and has an aperture 47, which is used for accommodating a coupling member 49 (see FIG. 6), which connects the apparatus 1 to the manual actuator 3.

The first switch 15 of the two series-connected switches 15, 17 is a normally open contact (NO contact) and the second switch 17 is a normally closed contact (NC contact). The second switch 17 is closed in its normal position, but the first switch 15 is not. The circuit is open. The circuit is closed by the first switch 15 being actuated. In the event of a subsequent actuation of the second switch 17, it is opened again and the electrical supply to the electric motor 13 is interrupted. Therefore, the electric motor 13 is only running when the first switch 15 has been actuated and the second switch 17 has not been actuated. On the other hand, if only the second switch 17 is actuated, it is opened and the circuit is also opened.

The manner in which the apparatus 1 functions will be explained in more detail with reference to FIGS. 1 to 4. In this situation shown in FIG. 1, the lever 7 is in its OFF end position. At the same time, the cam disk 29 is in its OFF basic position. The two OFF positions correlate to the switch-off position of the manual actuator 3 in the form of a switching rocker. In FIG. 1, at first both switches 15 and 17 are not actuated. The first switch 15 is actuated by the cam disk or by the edge of the coupling element 31 depending on the position of the lever 7. The second switch 17 is actuated only by the attachment 41.

Figure 2:
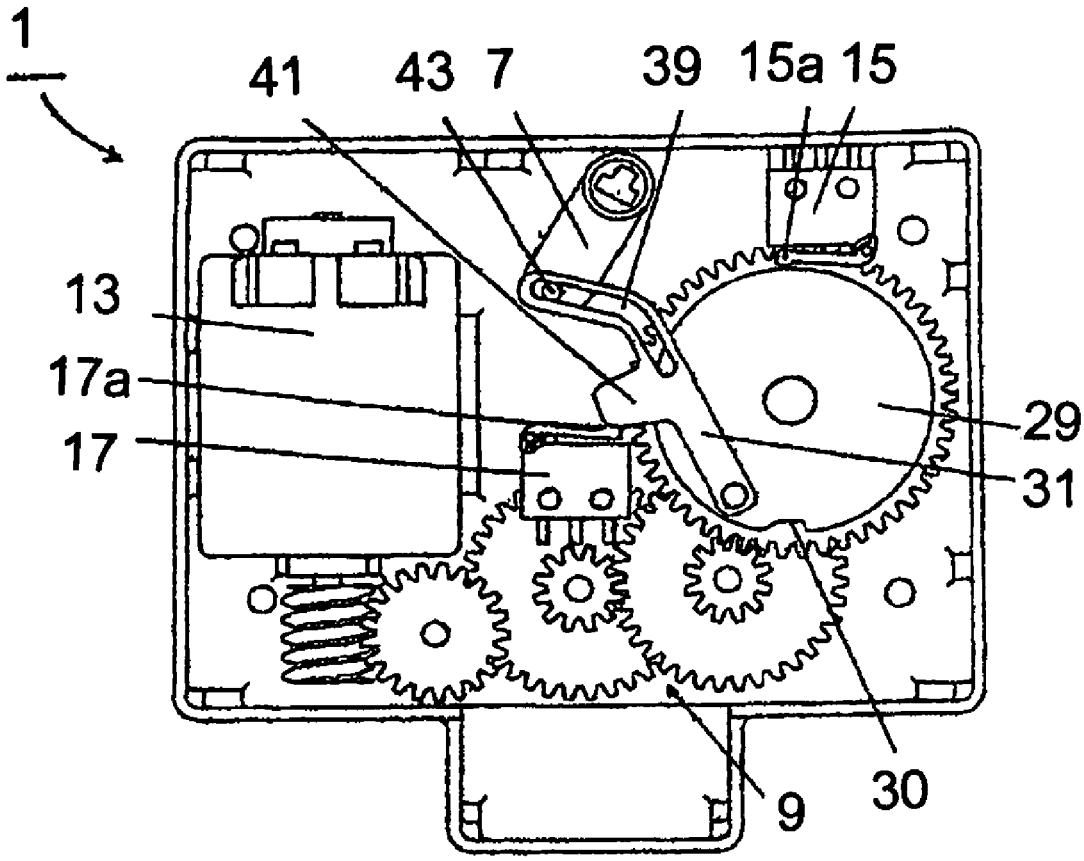
FIG. 2 is a diagrammatic, plan view of the apparatus shown in FIG. 1 in an ON end position of the lever.

In the event of a remote actuation of the apparatus, the cam disk 29 is brought into the ON basic position illustrated in FIG. 2. At the same time, the lever 7 is brought into its ON end position. The two ON positions correlate to the switch-on position of the manual actuator 3.

In order to move the cam disk 29 over from the basic position shown in FIG. 1 to the basic position shown in FIG. 2, the electric motor 13 receives a current pulse by remote actuation, for example by a pushbutton T (see FIG. 8), and begins to run. The cam disk 29 is rotated via the transmission 9. The pushbutton T needs to be pressed until the first switch 15 is actuated by the cam disk 29 and the switch 15 is closed. The switch 15 with the NO contact is connected such that, together with the NC contact, which is connected in series, of the switch 17, it takes over the continued electrical supply to the electric motor 13. The coupling element 31 engages with the right-hand side of the slot 39 on the pin 43 of the lever 7 and rotates the lever 7, via the lever arm, in the clockwise direction into the switch-on position of the manual actuator 3 of the circuit breaker 5. The electric motor 13 and the transmission 9 run automatically until the attachment 41 on the coupling element 31 actuates the second switch 17. The electrical supply to the electric motor 13 is interrupted by the actuation of the second switch 17.

FIG. 2 shows the OFF end position of the lever 7 and the corresponding basic position of the transmission 9. The cam disk 29 has made a revolution through 180° when switched over from the ON end position to the OFF end position. Each of the two switches 15, 17 has an actuator 15*a*, 17*a* for actuating the switches 15, 17. The cutout 30, in which, in the basic position of the transmission 9, the actuator 15*a* has been placed (see FIG. 1), is now located on the opposite side. The pin 43 of the lever 7 is approximately on the left-hand side of the slot 39 of the coupling element 31.

Owing to renewed actuation of the pushbutton T, the electric motor 13 again receives a current pulse and sets the transmission 9 in motion. The pushbutton T needs to be pressed until the attachment 41 on the coupling element 31 releases the actuator 17*a* at the second switch 17 and the electrical supply to the electric motor 13 is taken over by the NC contact of the second switch 17 together with the first switch 15, which is connected in series. Owing to the rotary movement of the cam disk 29, the coupling element 31 draws the pin 43 via the slot 39, and therefore the lever 7, into the OFF end position (see FIG. 1). The cam disk 29 comes to a standstill once again if the actuator 15*a* of the first switch 15 falls into the cutout 30 and therefore interrupts the electrical supply to the electric motor 13. The pin 43 of the lever 7 is then approximately on the right-hand side of the slot 39 (see FIG. 1).

Figure 3:
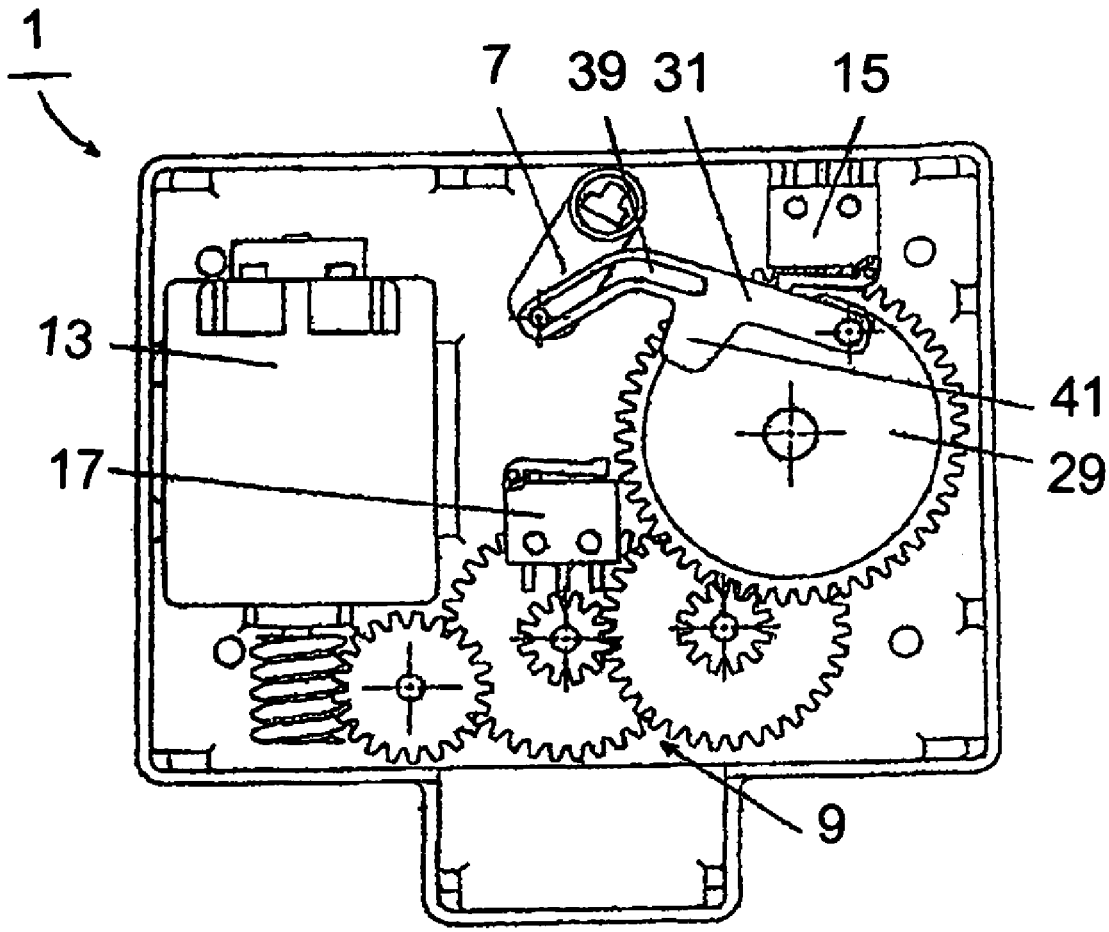
FIG. 3 is a diagrammatic, plan view of the apparatus shown in FIG. 1 once the lever has been moved over from the OFF end position to the ON end position manually.

FIG. 3 shows the situation once the lever 7 has been brought manually from the OFF end position into the ON end position. At first, the cam disk 29 is still located in the OFF basic position. The lever 7 and the cam disk 29 are therefore no longer correlated with one another. The apparatus 1 is configured such that, after the manual actuation, the cam disk 29 is automatically synchronized with the manually predetermined position of the manual actuator. In order to achieve this, in the event of the lever 7 being moved over into the ON end position manually, the coupling element 31 is lifted slightly such that its edge actuates the first switch 15 by the actuator 15*a*. The transmission 9 is set in motion via the two series-connected switches 15 and 17. The first switch 15 is now actuated via the cam disk 29. The slot 39 of the coupling element 31 is shaped such that it leaves the lever in the ON position. The cam disk 29 and the coupling element 31 move until the attachment 41 on the coupling element 31 actuates the second switch 17, and the position shown in FIG. 2 is reached.

If the circuit breaker 5 is switched on manually by the manual actuator 3, the drive mechanism 11 therefore automatically follows into its associated basic position. The actuator 15*a*, first actuated by the edge of the coupling element 31 and then by the cam disk 29, closes the circuit.

Figure 4:
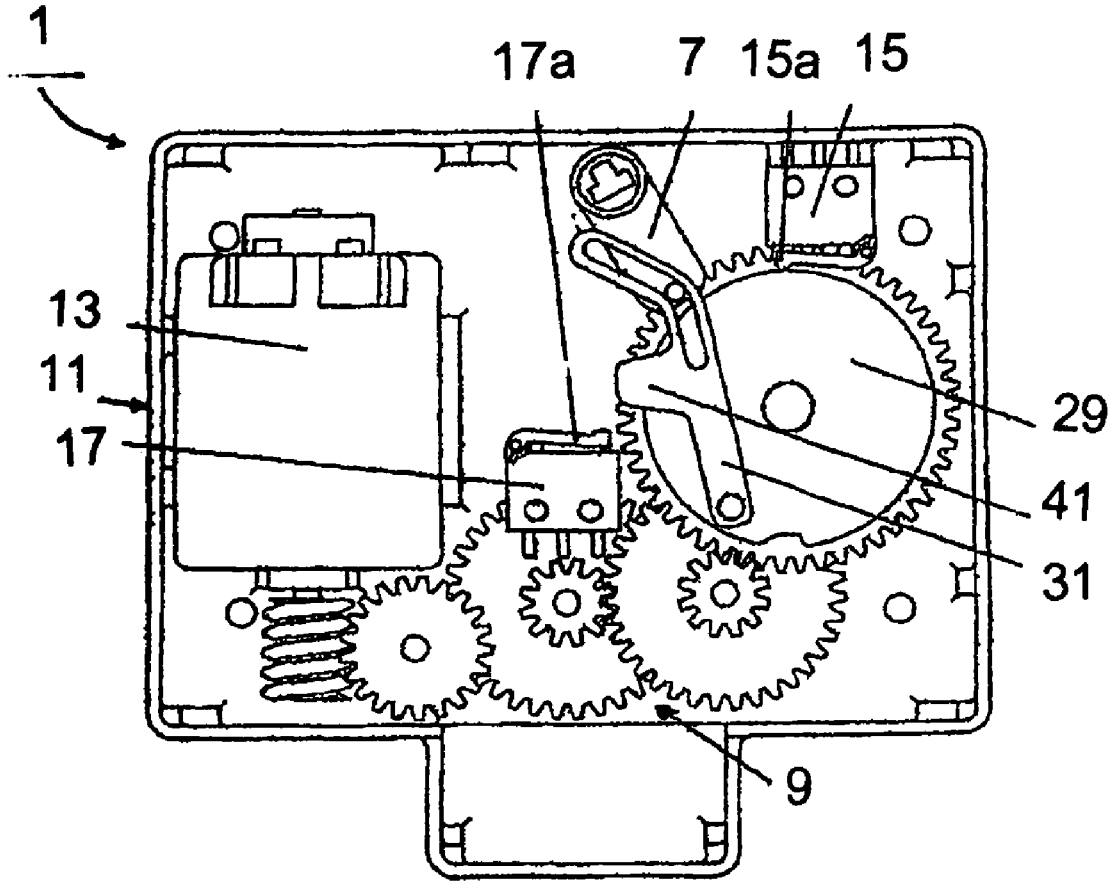
FIG. 4 is a diagrammatic, plan view of the apparatus shown in FIG. 1 once the lever has been moved over from the ON end position to the OFF end position manually.

FIG. 4 illustrates the reverse situation to that in FIG. 3, namely the situation once the lever 7 has been moved over manually from the ON end position to the OFF end position.

If the circuit breaker 5 is switched off manually by the manual actuator 3, the drive mechanism 11 follows automatically again. The lever 7, as shown in FIG. 1, is located in the OFF end position. The actuator 17*a* of the switch 17 is released by the attachment 41 of the coupling element 31. The electric motor 13 is supplied with current via the two series-connected switches 15 and 17 and sets the transmission 9 in motion. The cam disk 29 and the coupling element 31 connected to the cam disk 29 move until the actuator 15*a* of the first switch 15 falls into the cutout 30 and the switch 15 switches the drive mechanism 11 off. The basic position shown in FIG. 1 is therefore reached.

Figure 5:
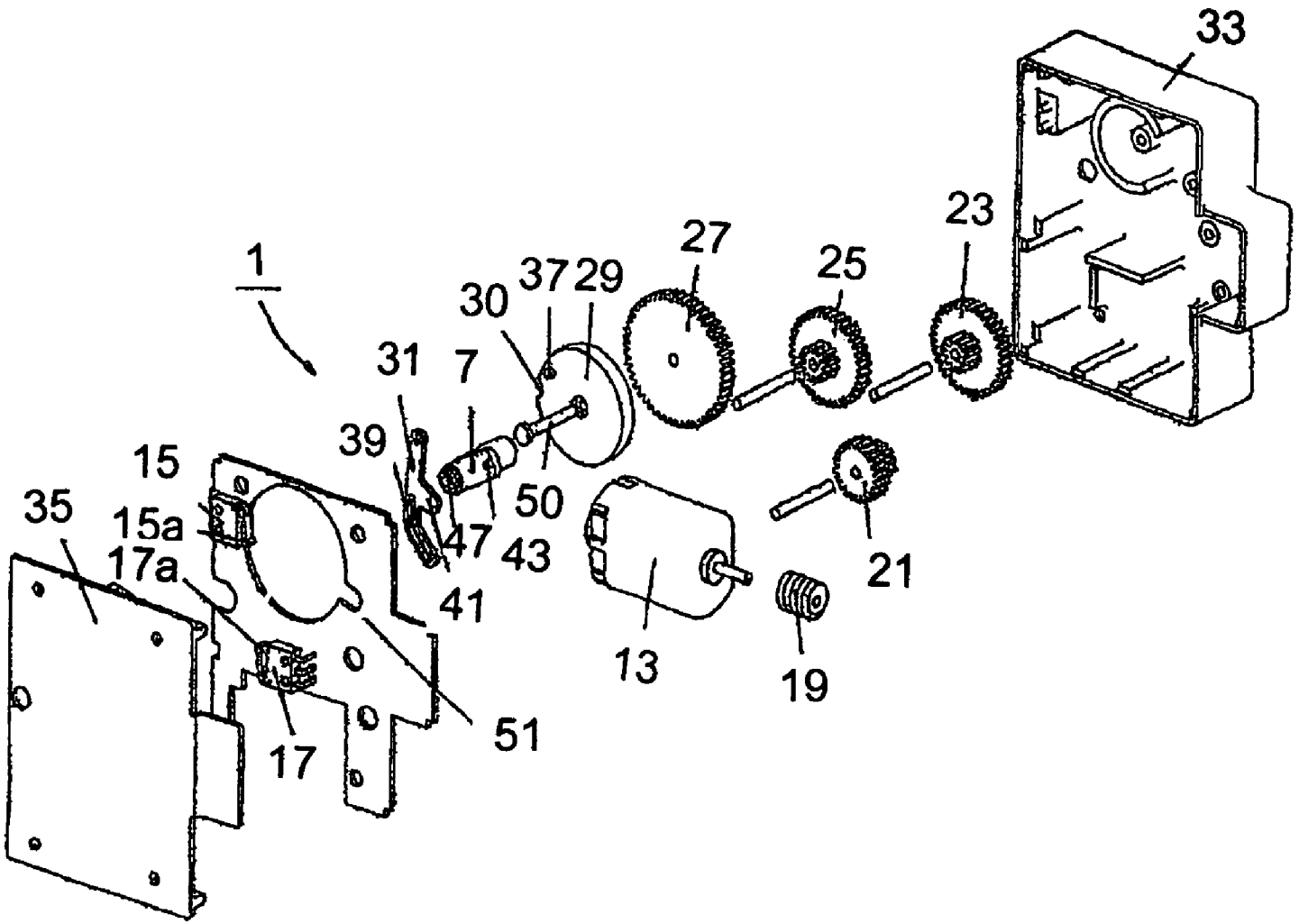
FIG. 5 is a diagrammatic, exploded perspective view of the components of the apparatus shown in FIG. 1.

An exploded illustration of the individual components of the apparatus 1 is illustrated in FIG. 5. It shows the lever 7 with the pin 43 and the aperture 47, the electric motor 13, the two switches 15 and 17 with the respective actuator 15*a* and 17*a*, the worm 19, the three stepped wheels 21, 23 and 25, the output gearwheel 27, the cam disk 29 with the cutout 30 and the axis, which represents the articulation point 37, the coupling element 31 with the slot 39 and the attachment 41. Also illustrated is a bearing pin 50 of the cam disk 29. The components of the apparatus 1 are mounted in the housing 33 and the cover 35. In this exemplary embodiment, the two switches 15 and 17 are arranged on a printed circuit board 51. In addition, electronic components, such as overload protection for the electric motor, modules for a bus link and various plug modules for the electrical supply to the drive mechanism 11, can be fixed on the printed circuit board.

Figure 6:
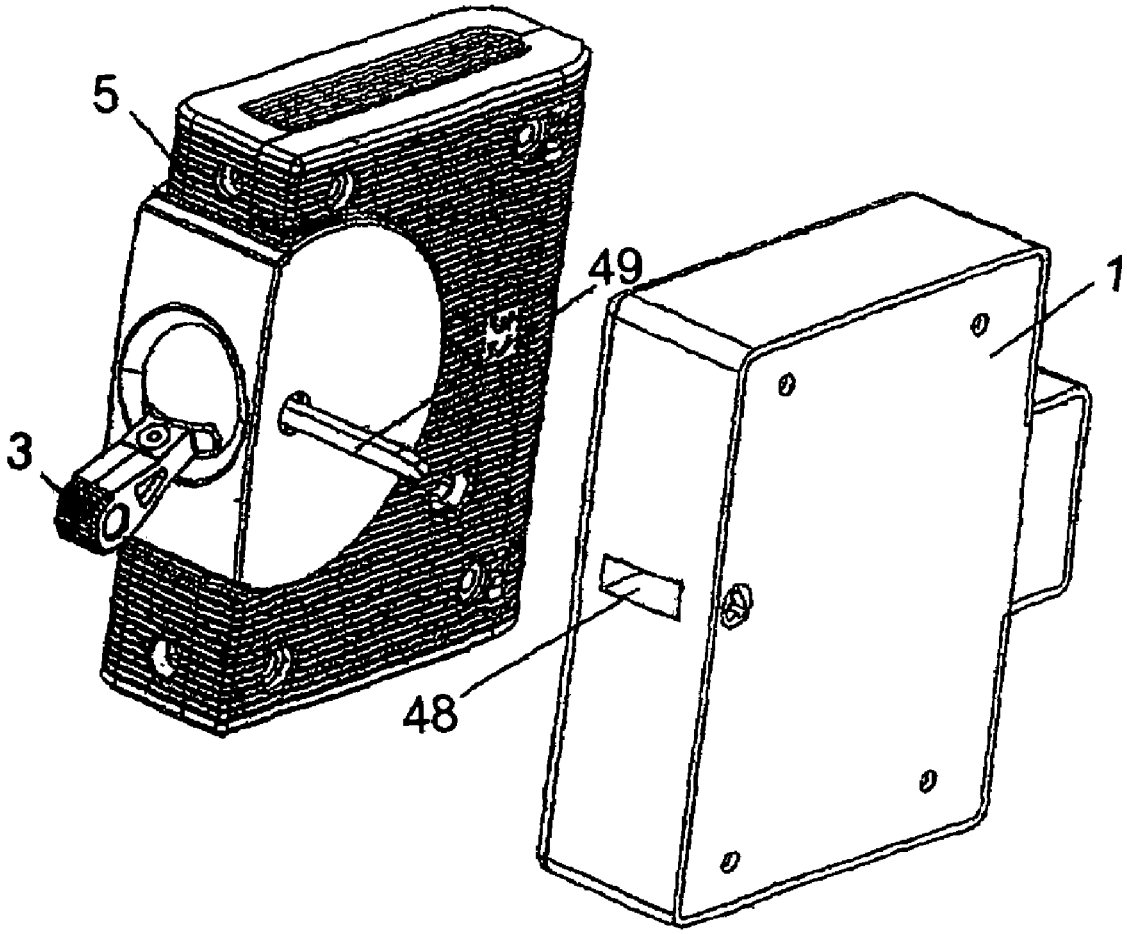
FIG. 6 is a diagrammatic, perspective view of a circuit breaker and an apparatus for remotely actuating the manual actuator of the circuit breaker.
Figure 7:
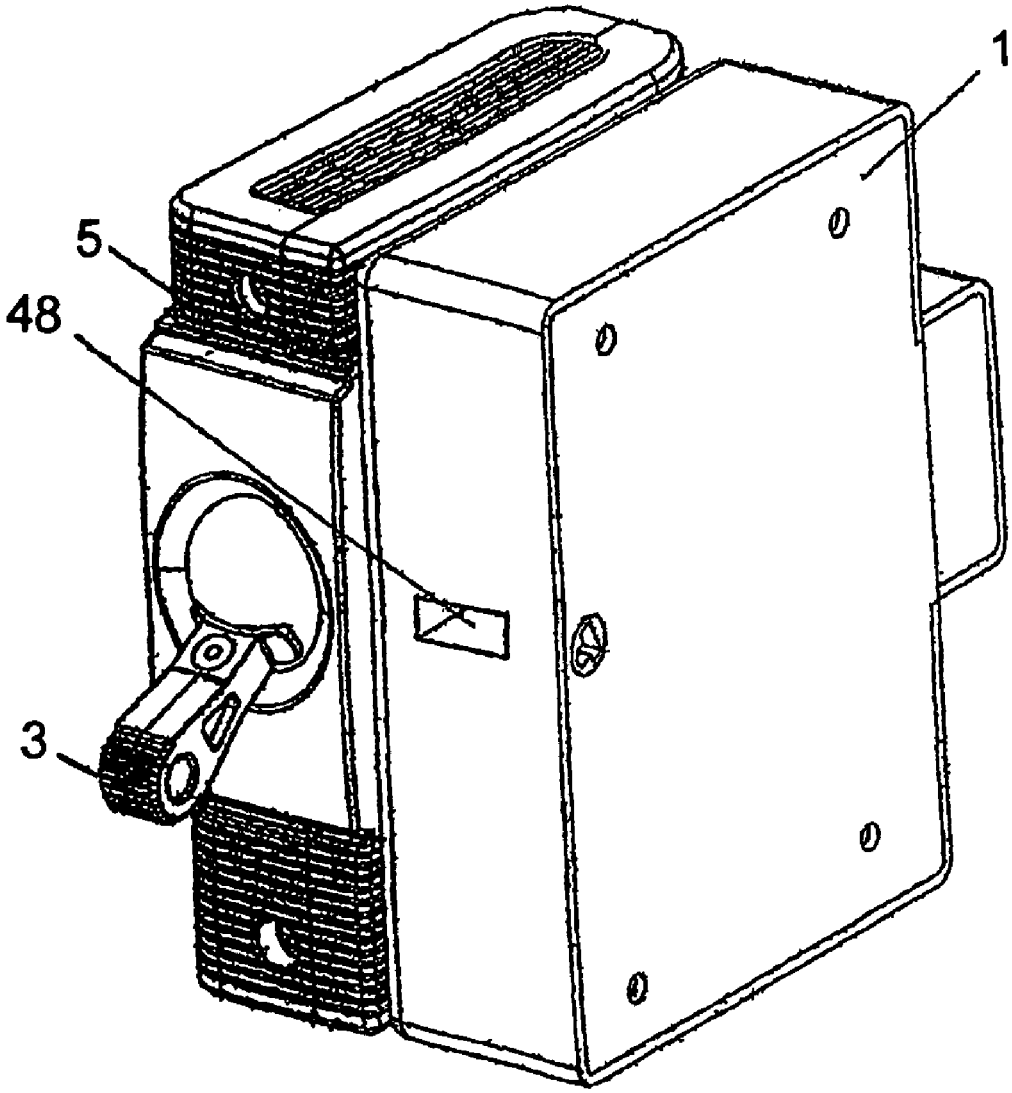
FIG. 7 is a diagrammatic, perspective view of the circuit breaker shown in FIG. 6 with the apparatus in the fitted state.

The circuit breaker 5 with the manual actuator 3 in the form of a switching rocker and the apparatus 1 for remotely actuating the manual actuator 3 are shown in FIG. 6 and FIG. 7. The manual actuator 3, which is in the form of a switching button, and the apparatus 1 are connected to one another with the aid of the coupling member 49, which has the form of a pin. The apparatus 1 has approximately the size of the circuit breaker 5 and is in the form of an adapter, which can be fixed to the circuit breaker 5, as shown in FIG. 7. The circuit breaker 5 has a visual inspection window 48 for a mechanical display of the switching state. The apparatus 1 can at the same time also be connected to a plurality of circuit breakers 5 by the coupling member 49. The circuit breaker 5 is provided in a power distribution system, for example for an operational communication network, in particular for protecting individual line phases or channels from excess current.

FIGS. 8 to 11 each show a circuit diagram with in each case different pushbuttons or switches for switching the electric motor on and off for remote actuation. All of the figures illustrate the two switches 15 and 17, the electrical supply (denoted by + and −), a diode D, a resistor R and the electric motor 13 with associated electrical motor protection 53. The diode D is used for polarity reversal protection and only allows one direction of rotation of the drive mechanism 11. The circuit has, depending on the actuation of one of the two switches 15 and 17, two possible current paths for supplying the electric motor 13. The first switch 15 is a normally open contact, which is open in the normal position. The second switch 17 is a normally closed contact, which is closed in the normal position.

Figure 8:
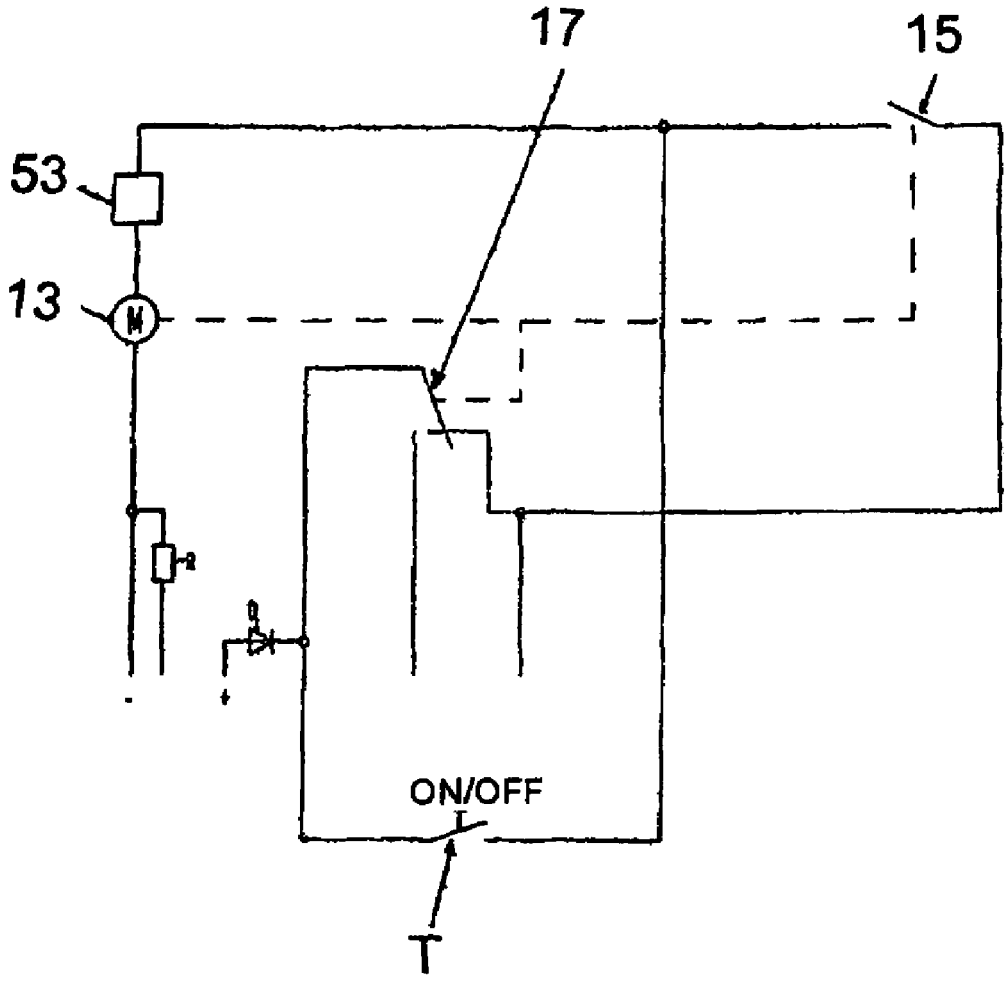
FIG. 8 is a first circuit diagram of the apparatus with a pushbutton for switching the electric motor on and off.

In the embodiment of the apparatus 1 shown in FIG. 8, only one pushbutton T for switching the electric motor 13 on in the event of remote-controlled operation of the apparatus 1 is provided. In the event of this pushbutton T being actuated, the circuit is closed irrespective of the state of the two switches 15 and 17, and the electric motor is supplied with current. On each actuation of the pushbutton T, the cam disk 29 is therefore moved from one basic position into the other basic position. The pushbutton T in the process needs to be actuated until the switch 15 is actuated by the cam disk 29 (see FIG. 1) or until the attachment 41 releases the switch 17 (see FIG. 2). The functional sequence corresponds to the pulsed operation with a pushbutton T, which has been explained in more detail in the description relating to FIGS. 1 and 2.

Figure 9:
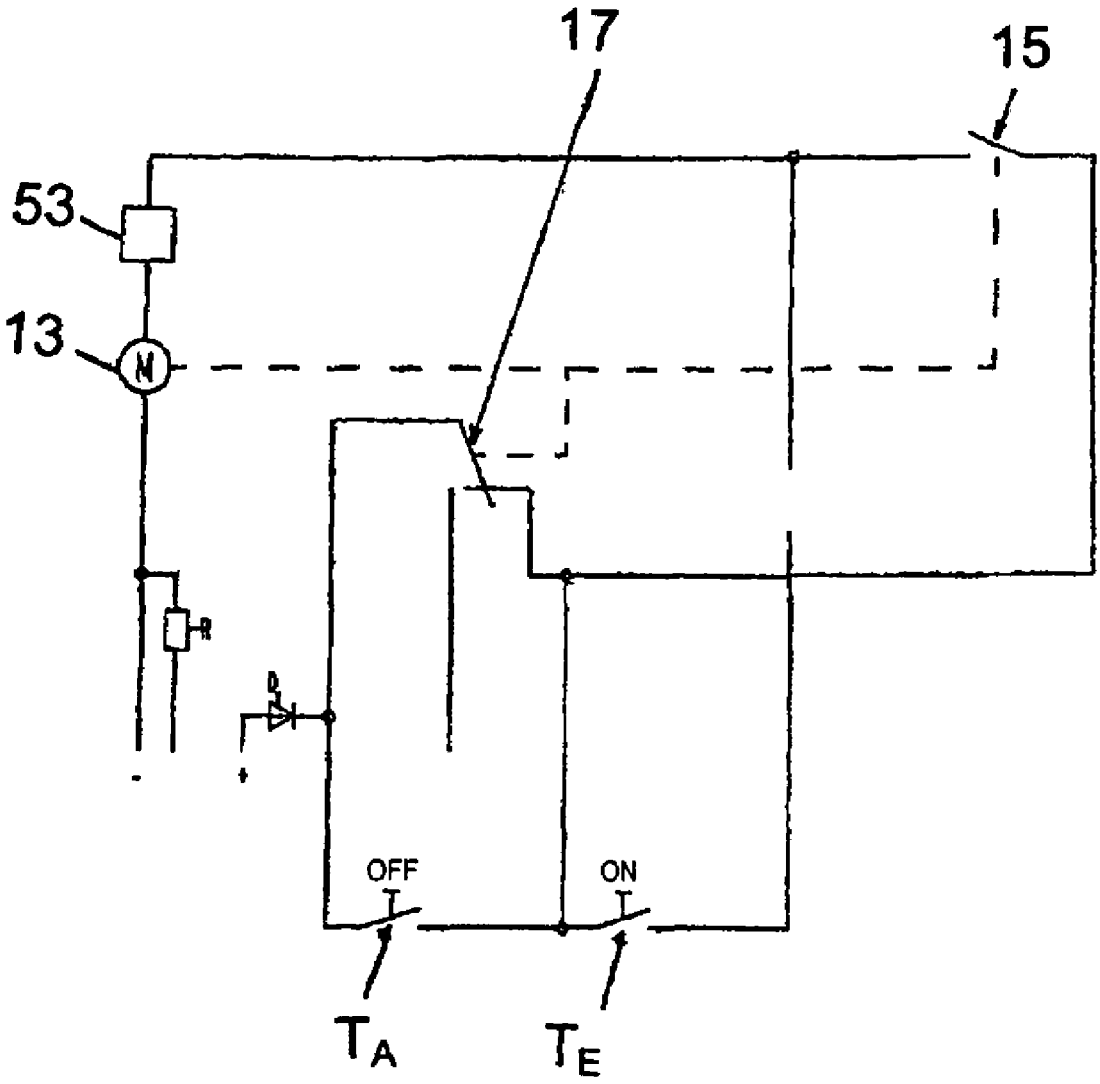
FIG. 9 is a second circuit diagram of the apparatus with two separate ON and OFF pushbuttons.

In FIG. 9, two separate pushbuttons, namely an ON pushbutton $T_E$ and an OFF pushbutton $T_A$ are provided for switching the electric motor 13 on and off. The ON pushbutton $T_E$ needs to be actuated until the switch 15 is actuated by the cam disk 29. The OFF pushbutton $T_A$ needs to be actuated until the attachment 41 on the coupling element 31 releases the actuator 17*a* of the switch 17 (see FIG. 2).

Figure 10:
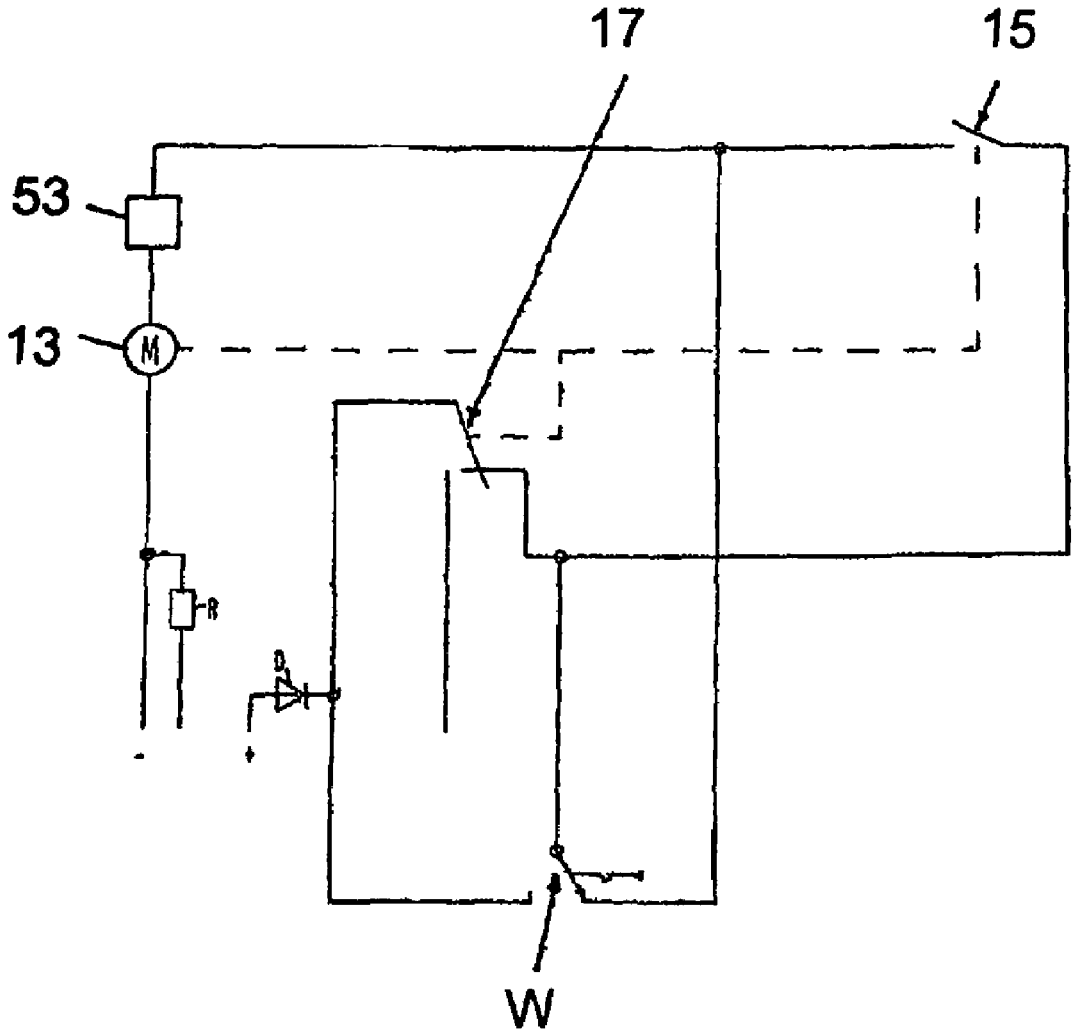
FIG. 10 is a third circuit diagram of the apparatus with a changeover switch.

The exemplary embodiment in FIG. 10 has a changeover switch W for switching the electric motor 13 on and off. Depending on the positioning of the changeover switch W, the circuit is closed via the first switch 15 or via the second switch 17. In accordance with the exemplary embodiment in FIG. 10, the changeover switch W is in the "on" position and the circuit is closed via the second switch 17. The cam disk 29 moves from the OFF basic position (FIG. 1) into the ON basic position (FIG. 2). As result, the switch 15 is first closed. When the ON basic position (FIG. 2) is reached, the switch 17 is opened. In the event of the changeover switch W being reversed, the cam disk 29 is moved into the OFF basic position again. At first, the electric motor 13 is started via the closed switch 15. Right at the start the switch 17 is opened. The current path remains closed via the switch 15 until the cam disk 29 reaches the OFF basic position and opens the switch 15, with the result that the power supply is interrupted. The changeover switch W is provided for a configuration in which the circuit breaker 5 does not have a manual actuator 3 and can therefore not be actuated manually.

Figure 11:
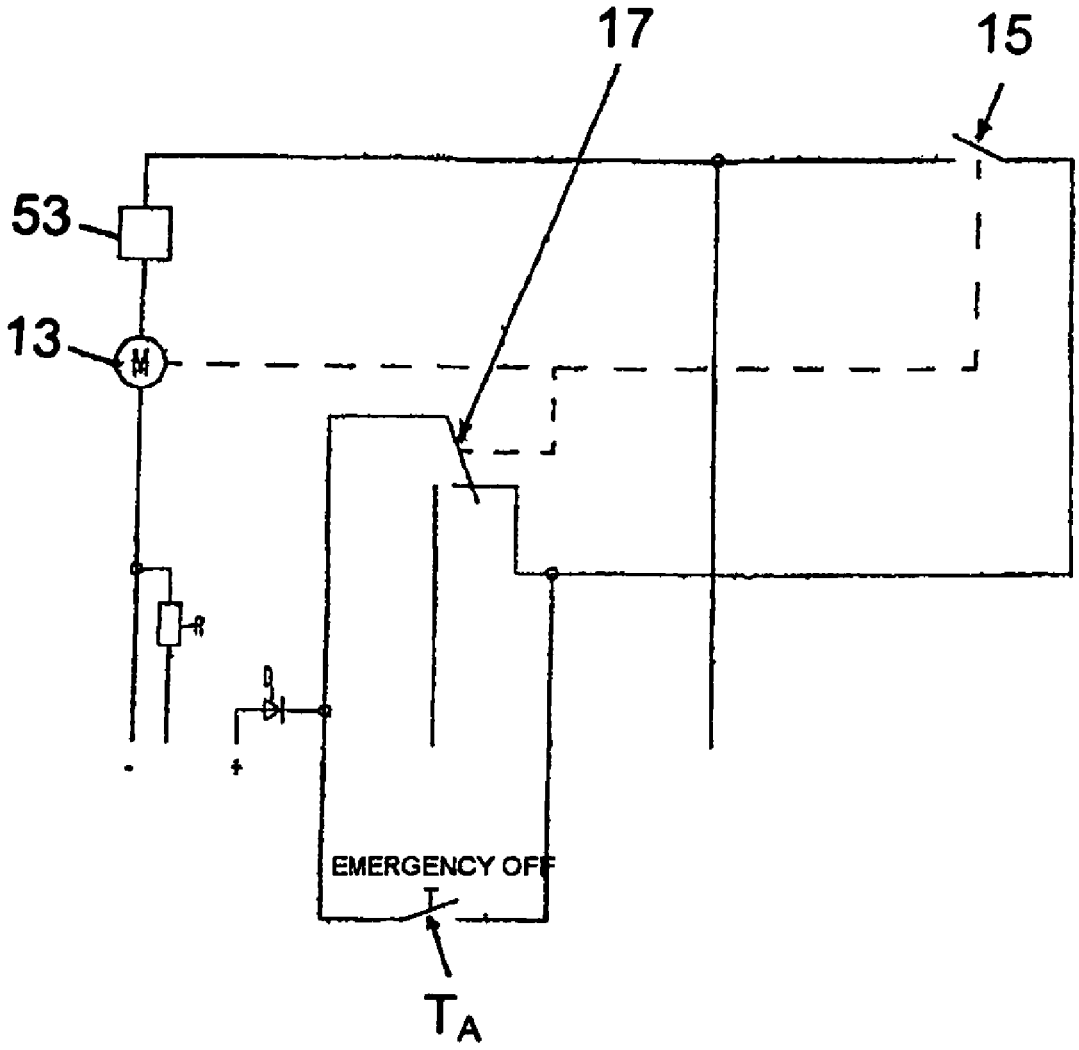
FIG. 11 is a fourth circuit diagram of the apparatus with an EMERGENCY OFF pushbutton.

In accordance with the variant embodiment in FIG. 11, only one EMERGENCY OFF switch is used. The apparatus 1 can only be switched off by remote actuation by this switch.

The circuit breaker 5 and the apparatus 1 can only be switched on by the manual actuator 3 of the circuit breaker 5.

Figure 12:
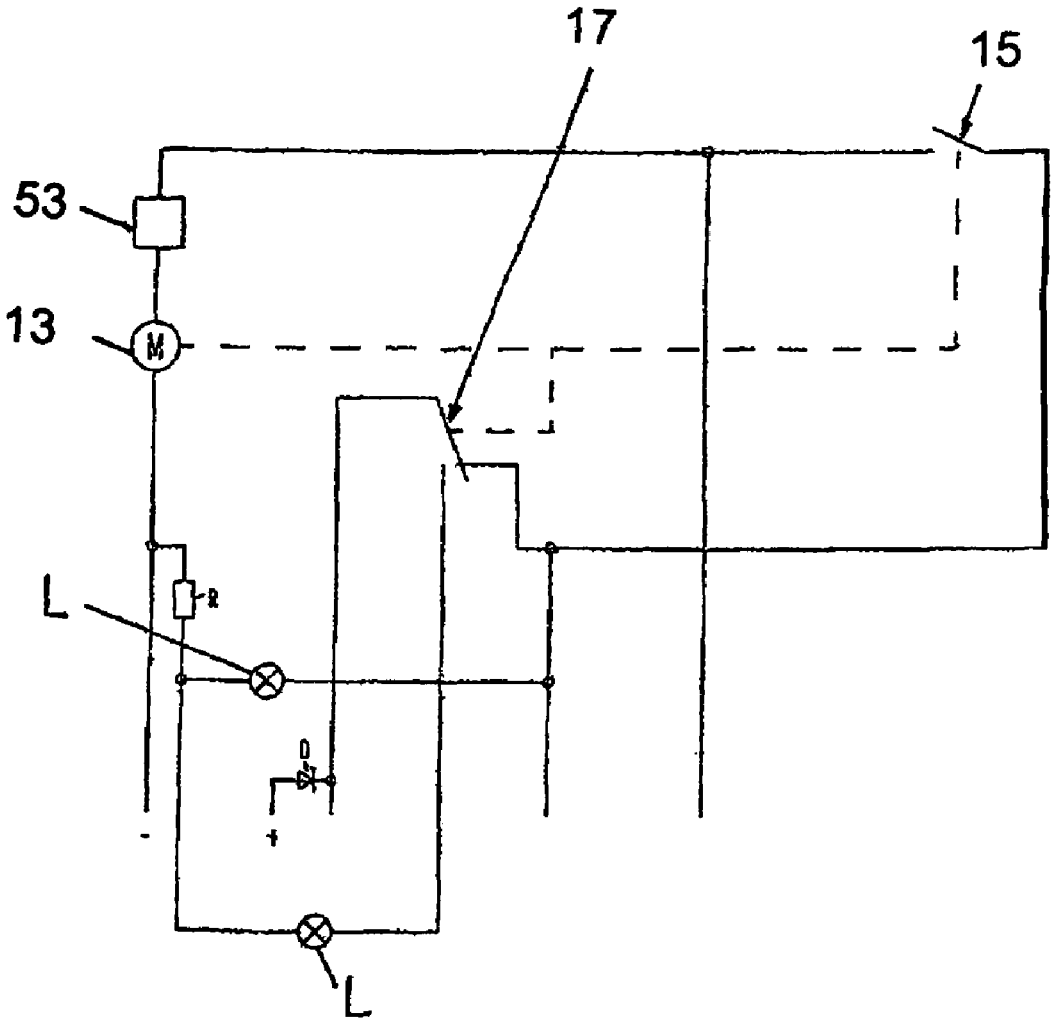
FIG. 12 is a circuit diagram, in supplementary fashion to the circuit diagrams shown in FIGS. 8 to 11, in which, in addition, a switching state display is provided.

For all subsequent variants which are shown in FIGS. 8 to 11, a switching state display by an LED or lamp L is possible. This is illustrated in FIG. 12. Signaling can take place on the apparatus 1, for example by LEDs which are arranged on the printed circuit board 51 and are passed to the outside through openings in the housing 33. Alternatively, signaling can also take place, for example, on a control panel physically separate from the apparatus 1 and the switch 5. The two lamps L illustrated are in this case configured such that, as a function of the switching positions of the switch, in each case precisely one lamp L is illuminated. In this case, the resistor R is used for matching or stabilizing the supply voltage for the lamps L. In place of the resistor R, a zener diode or the like can also be used.

We claim:

1. An apparatus for remotely actuating a circuit breaker having two stable positions including a switch-on position and a switch-off position, the apparatus comprising:

a drive mechanism having:

an electric motor;

switches, including a first switch and a second switch, for switching said electric motor on and off;

a transmission capable of being positioned in two basic positions, including a first basic position and a second basic position; and a coupling mechanism having a lever for mechanically coupling said drive mechanism to the circuit breaker, said lever having two end positions and being capable of being moved from a first end position into a second end position with an aid of said drive mechanism, said drive mechanism configured such that, in an event of said lever being moved over manually from the first end position into the second end position, one of said first and second switches is actuated, resulting in said transmission moving over from the first basic position into the second basic position.

2. The apparatus according to claim 1, wherein said first and second switches are disposed in series, said first switch is a normally open contact, and said second switch is a normally closed contact.

3. The apparatus according to claim 1, wherein said lever has an axis of rotation, about which it can be rotated when switching over from the first end position to the second end position along an arc of a circle.

4. The apparatus according to claim 1, wherein said drive mechanism has a cam disk, and the two basic positions of said transmission being defined via said cam disk.

5. The apparatus according to claim 4, wherein said cam disk is capable of rotation only in one direction.

6. The apparatus according to claim 4, wherein said cam disk actuates said first switch via a direct contact.

7. The apparatus according to claim 4, wherein said coupling mechanism has a coupling element, said lever being connected to said cam disk via said coupling element, said coupling element disposed on said cam disk such that said coupling element can rotate at an articulation point, the articulation point being spaced apart from an axis of rotation of said cam disk.

8. The apparatus according to claim 7, wherein:

said lever has a pin; and said coupling element has a slot formed therein with a slotted link form, said pin of said lever runs in said slot.

9. The apparatus according to claim 7, wherein said coupling element has an attachment provided for mechanically contacting said second switch.

10. The apparatus according to claim 7, wherein said first switch is capable of being actuated by one of said coupling element and said cam disk via a direct mechanical contact.

11. The apparatus according to claim 1, further comprising a coupling member; and wherein said lever has a driver for accommodating said coupling member, which, in a fitted state, is connected to a manual actuator of the circuit breaker.

12. The apparatus according to claim 1, further comprising a pushbutton and said electric motor is capable of being switched on and off by said pushbutton.

13. The apparatus according to claim 1, further comprising one of separate ON and OFF pushbuttons and a changeover switch, on whose actuation said transmission is capable of being moved over from the first basic position into the second basic position, and vice versa.

14. The apparatus according to claim 1, further comprising only one OFF pushbutton, on whose actuation said transmission is moved into a basic position, which is correlated with a switch-off position of a manual actuator of the circuit breaker.

* * * * *